United States Patent [19]

Koefferlein

[11] Patent Number: 4,737,045

[45] Date of Patent: Apr. 12, 1988

[54] PAPER WEB STACKING CONTROLLED BY ELECTRONIC MOTOR CONTROLLED BY FORM LENGTH

[75] Inventor: Rainer Koefferlein, Munich, Fed. Rep. of Germany

[73] Assignee: Siemens Aktiengesellschaft, Berlin and Munich, Fed. Rep. of Germany

[21] Appl. No.: 882,711

[22] Filed: Jul. 7, 1986

[30] Foreign Application Priority Data

Aug. 6, 1985 [DE] Fed. Rep. of Germany ..... 3528223

[51] Int. Cl.[4] ..... B41J 11/46

[52] U.S. Cl. ..... 400/613.2; 270/39; 493/413; 226/23; 226/33; 226/45

[58] Field of Search ..... 400/613.2; 493/358–360, 372, 423, 441, 411, 410, 413–415, 434–435; 270/39, 30; 271/198, 201; 226/10, 15, 18, 23, 32, 33, 42, 45

[56] References Cited

U.S. PATENT DOCUMENTS

| | | | |
|---|---|---|---|
| 3,589,709 | 6/1971 | Hudderesfield | 493/441 |
| 3,627,306 | 12/1971 | Affupper | 493/413 |
| 4,493,689 | 1/1985 | Affupper | 493/411 |
| 4,573,670 | 3/1986 | Felix | 493/413 |
| 4,670,001 | 6/1987 | Campbell et al. | 493/413 |

FOREIGN PATENT DOCUMENTS

| | | | |
|---|---|---|---|
| 2402027 | 7/1975 | Fed. Rep. of Germany | 493/413 |

*Primary Examiner*—E. H. Eickholt

*Attorney, Agent, or Firm*—Hill, Van Santen, Steadman & Simpson

[57] ABSTRACT

In a paper stacking device for pre-folded continuous form paper wherein the paper web is supplied to a deposit table from below and the paper stack is built up proceeding from below, a stepping motor is coupled in terms of drive to the feed region, this stepping motor generating the reciprocating stacking motion by reversal of rotational sense, whereby the lift and the motion sequence are controllable via an electronic control device dependent on the form length. The seating surface for the acceptance bands accepting the paper stack is formed by discrete support elements; the deflection rollers themselves thereby serve for taking up the supporting bands. The paper stacking device can be an integrated component of the printer and is pivoted into and out of the latter.

14 Claims, 5 Drawing Sheets

FIG 6
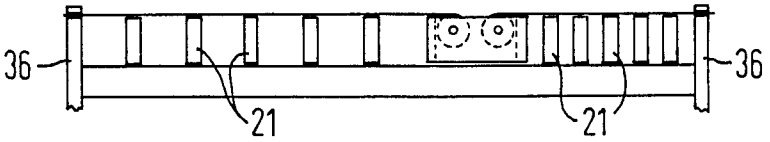
FIG 7
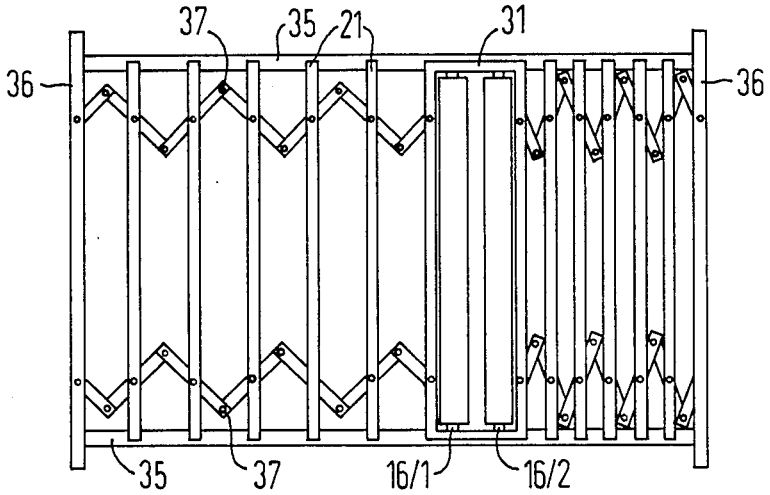
FIG 8
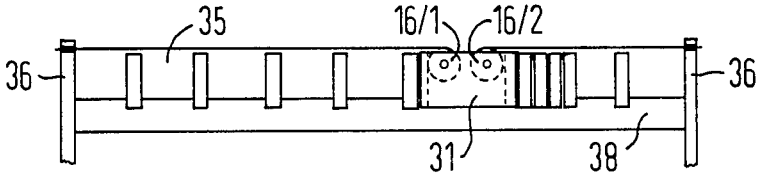
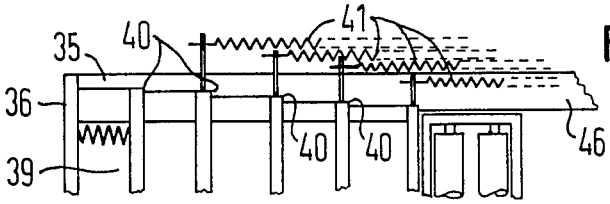
FIG 9

PAPER WEB STACKING CONTROLLED BY ELECTRONIC MOTOR CONTROLLED BY FORM LENGTH

BACKGROUND OF THE INVENTION

1. Field of the Invention

The invention relates to a paper stacking device for pre-folded continuous form paper wherein the paper web is supplied to a deposit table from below and the paper stack is built up preceeding from below.

2. Description of the Prior Art

Such paper stacking devices are known and have been successfully employed. They generally include a table top which is horizontally movable in guides and which is moved back and forth by a stroke which proceeds somewhat beyond the form length of the continuous fanfold stock, being moved via an eccentric drive. The stacked paper rests on two support bands whose both ends are clamped at one side at the stacker housing, these support bands being conducted at the underside of the table via two deflecting rollers seated at an opening of a table. After the first sheets have been manually placed into the proper position, the paper web is introduced and unrolled under the stack by the lifting motion of the table and the rolling motion of the support bands. Acting as a flyback barrier, obliquely placed bristles at the end point of the stack or, respectively, at the reversing points of the table motion prevent a slide back of the paper.

An conjunction with high-performance printers as represented, for example, by laser printers, such paper stacking devices have the disadvantage that they require a great deal of space for the required table top including the lifting motion. Moreover, every form length must be separately set via the eccentric drive.

SUMMARY OF THE INVENTION

The object of the invention is to design a paper stacking device of the species initially cited such that a simple readjustment to different paper formats is possible and that the overall device has the smallest possible space requirement. The paper stacking device should be designed such that integration into a high-performance printer becomes possible and high operating ease is possible.

Given a paper stacking device of the type described above, this object is achieved by coupling an electronically controlled drive motor to a feed region, the drive motor being reversible in a rotational sense in order to produce the reciprocating stack movement whereby lift and motion sequence are controllable via a electronic control means dependent on the form length.

As a consequence of the fact that an electronically controlled drive motor, for example, a stepping motor, coupled to the feed region in terms of drive is provided, this drive motor being reversible in rotational sense in order to produce the reciprocating stacking motion, whereby the lift and the motion sequence is controllable via an electronic control means dependent on the form length, the paper stacking device can be easily adapted to different paper formats and the overall paper stacking device becomes so small in terms of its dimensions that it can be integrated into the printer housing.

In accord with an advantageous embodiment of the invention, the paper stacking device can thereby be designed in order to be pivotable into and out of the printer housing.

The design of the support surface for the supporting bands in the form of coupled discrete elements enables a low-mass design of the support surface, this significantly facilitating the reciprocating motion of the feed region and thus enabling the use of a motor having small dimensions. The motor can thereby be both stationarily allocated to the paper stacking housing and can also be immediately allocated to the paper deflection rollers of the feed region, whereby the drive motor is then moved together with the feed region.

BRIEF DESCRIPTION OF THE DRAWINGS

Embodiments of the invention are shown in the drawings and shall be set forth in greater detail below by way of example. Shown therein are:

FIG. 6 is a schematic view of the deposit table comprising a plurality of individual discrete elements arranged parallel to the deflection rollers.

FIG. 7 is a schematic illustration of the same deposit table from above wherein the discrete elements of the support surface are mechanically coupled to one another.

FIG. 8 is a side view of a deposit table comprising discrete elements wherein the supporting rollers have their radii projecting slightly above the supporting elements.

FIG. 9 is a side view of a deposit table comprising supporting elements which lie against resilient detents.

DESCRIPTION OF THE PREFERRED EMBODIMENTS

Figure 1:
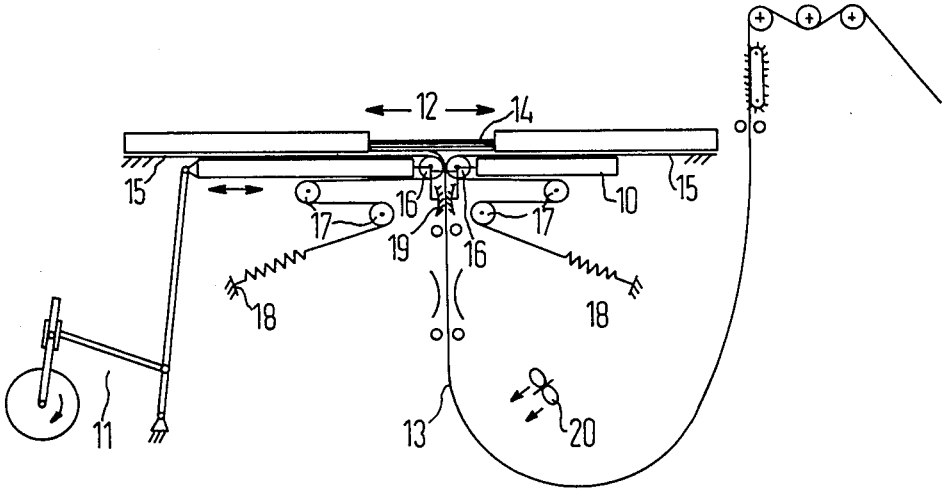
FIG 1 (PRIOR ART)
FIG. 1 is a schematic illustration of a known paper stacking device.

A known paper stacking device schematically shown in FIG. 1 is composed of a table top 10 horizontally movable in guides which is moved back and forth by a stroke proceeding somewhat beyond a form length 12 of a pre-folded continuous form paper 13, being moved by an eccentric drive 11. Stacked paper 14 lies on two support bands 15 which are immovably clamped at both ends to the stacker housing, these support bands 15 being conducted at the underside of the table via two deflection rollers 16 seated at an opening of the table.

After the first sheets have been manually placed into the proper position, the paper web 13 is rolled in under the stack 14 proceeding from below, being rolled in by means of the lifting motion of the table 10 and the rolling motion of the support bands. The support bands 15 are thereby guided at the underside of the table via further deflection rollers 17 and are secured to the stacker housing via spring elements 18. Obliquely placed bristles 19 of a flyback barrier at the end points of the stack 14 or, respectively, at the reversing points of the table motion prevent a slide back of the paper. A blower 20 takes care of the proper entry of the paper web 13 at the entrance of the feed region of the stacker means.

Due to the size of the table top including the lifting motion, a stacking device constructed in this way requires a large space. When the form length is changed, the eccentric drive must be separately set.

Figure 2:
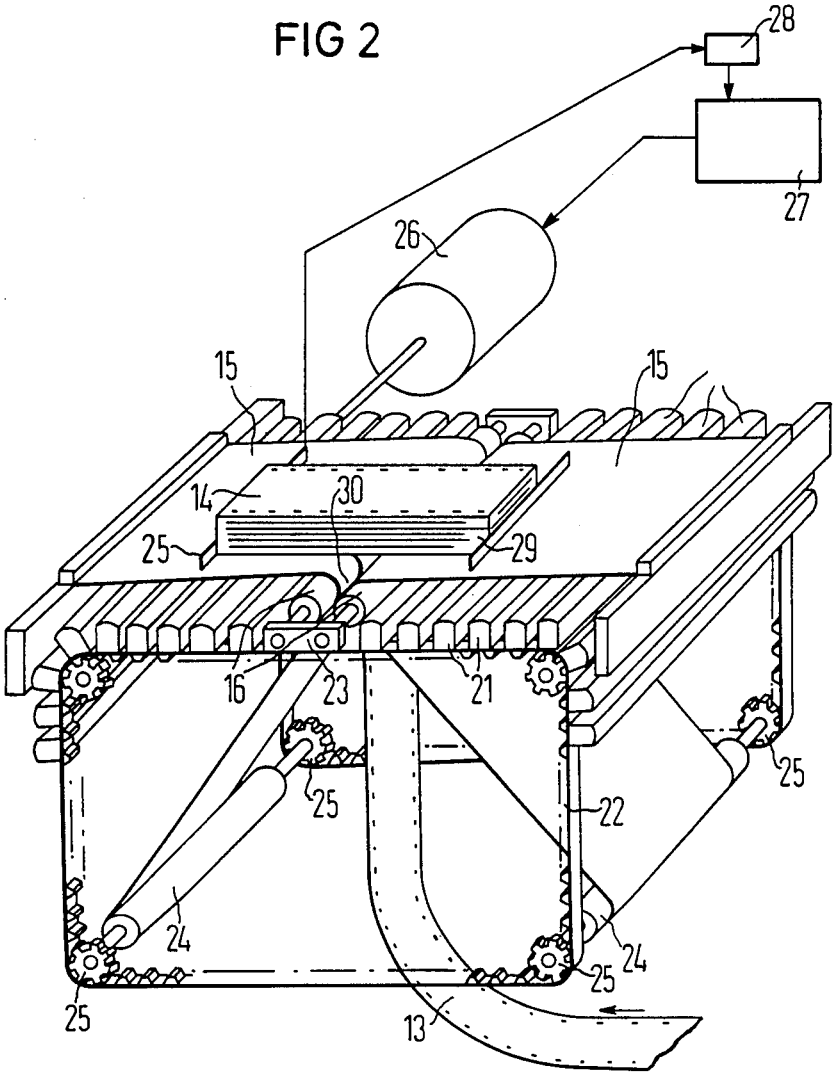
FIG. 2 is a schematic illustration of an embodiment of a paper stacking device incorporating the present invention wherein the supporting elements forming the support surface and the feed region are arranged on endless traction means coupled to the drive motor.

Given the exemplary embodiment of the stacker device of the invention shown in FIG. 2, the table top, i.e. the deposit surface for the support bands 15, is composed of a plurality of support elements 21 which are arranged on two continuous traction means 22 in the form of a pair of toothed belts or chains which are arranged at the ends of the support elements. A feed region 23 with the deflection rollers 16 secured thereto are likewise connected to a continuous traction means 22. Two takeup rollers 24 which are likewise in engagement with the continuous traction means 22 via toothed gears 25 are arranged under the feed region 23 for taking up the support bands 15. The paper stacker means is driven via a stationary drive motor 26 which, for example under electronic control, is fashioned as a stepping motor which can be reversed in drive direction and which is likewise in engagement with the continuous traction means 22. The drive motor 26 is driven via an electronic means 27 which can be composed of a standard drive device for stepping motors—comprising a means generating a rotary field, a counting means, etc. and which contains an input means 28 for setting the form length. For example, this setting of form length can ensue automatically, namely, by sensing the detents 29 which accept the stack 14. Instead of the detents 29, automatically acting light barriers, etc. can also be provided. Given high-performance printers for forms printing, the information concerning the form length is also already present by necessity. It would therefore be conceivable to undertake the setting of the form length directly via drive signals which the printer control supplies.

In addition to the setting of the form length, the idle position of a conveying gap 30 and, thus, the position of the feed means 23 can also be prescribed in an electronic way and the motion sequence can likewise be thusly defined.

During stacking, the feed means 23 with the paper web 13 supplied therein is moved back and forth in accord with the stacking operation, being moved with the assistance of the drive motor 26 which changes in rotational sense. The support elements 21 thereby support the supporting band 15 which are wound onto and taken off from the takeup rollers 24 in accord with the pivot motion, whereby resilient elements in accord with a spring window shade can be provided for keeping the supporting bands 15 taut in the takeup rollers 24.

Figure 3:
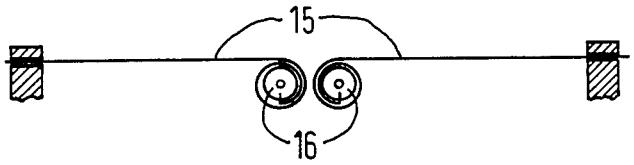
FIG. 3 is a schematic sectional view of the feed region of the paper stacking device wherein the deflecting rollers are fashioned as takeup reels.

Given an exemplary embodiment illustrated in FIG. 3, the two supporting bands 15 are secured to the deflection rollers 16 and are wound up. For this purpose, spring elements (not shown here) can be provided in the rollers 16. The different winding diameter dependent on the band thickness and on the position of the deflection rollers, however, can frequently be neglected, especially given thin and adequately elastic supporting bands 15.

Figure 4:
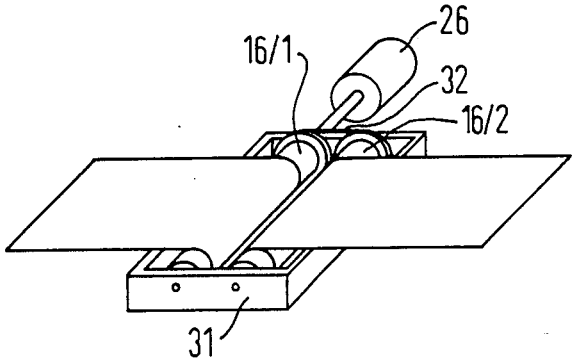
FIG. 4 is a schematic illustration of the feed region of the paper stacking device with the allocated, entrained drive motor.

When the two deflection or, respectively, takeup rollers 16 are seated in a carriage movable in guides in accord with the illustration of FIG. 4, one of these deflection rollers 16/1 can be directly driven by a drive motor 26 and the second deflection roller 16/2 can be driven via a toothed belt 32. Dependent on the rotational sense of the drive motor, the carriage 31 with the two rollers 16/1 and 16/2 seated therein consequently moves toward the right or toward the left, whereby the one deflection roller winds up the supporting band 15 and the other deflection roller releases the supporting band 15. The drive motor 26 is thereby moved along with the carriage.

Figure 5:
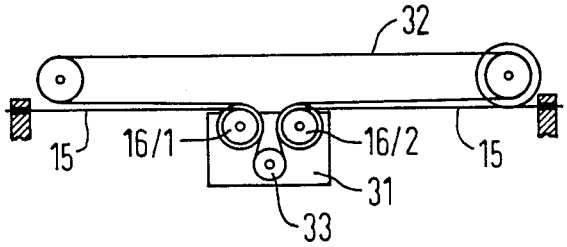
FIG. 5 is a schematic illustration of the feed region of the paper stacking device comprising a stationary drive motor which is in engagement with the deflection rollers of the feed region via a toothed belt.

As in an exemplary embodiment in accord with FIG. 5, however, the drive motor can also be stationarily arranged. In this case, the carriage 31 (guide region) also contains a deflecting wheel 33 in addition to the two deflection rollers 16/1 and 16/2 and the toothed belt which, for example, can also be a chain which is driven by the motor is deflected via this deflecting wheel 33.

The size of the stacking device can be further drastically reduced when the support elements 21, differing from the illustration of FIG. 2, are not connected to deflection rollers 16 or, respectively, winding rollers 16/1, 16/2 via links (for example chain links), but these are arranged on coulisses 35 displaceable in one plane in accord with the illustration of FIGS. 6 and 7. FIGS. 6 and 7 shown an embodiment wherein the supporting bands 15 are supported by five support elements 21 in the region between the winding rollers 16/1 and 16/2 and end plates 36. In this case, the spacing of the five supporting elements relative to one another is kept constant by means of slidable lattice gates 37. At their ends, the support elements are thereby supported on glide on seating surfaces 35. In order to reduce the friciton between the supporting bands 15 loaded by the paper stack and the support elements 21, these support elements 21 can also be equipped with rollers As shown in the exemplary embodiments of FIGS. 8 and 9, the relative motion between the supporting elements 21 and the support bands 15 loaded by the paper stack 14 can be largely avoided. The support elements 21 are guided on seating surfaces 38, whereby each support element has a free motional latitude between a common end stop 39 at the end plate and a second, individual end stop 40. Each support element 21 is pushed against the individual end stops 40 by individual springs 41 (or compression springs) as long as it is not in the way of the motion of the carriage 31 with the winding rollers. As soon as the carriage 31 is located within the motional latitude of the support element 21, the latter is placed against the carriage 31 and moves together with it. In accord with the exemplary embodiment of FIG. 8, it is advantageous to seat the winding rollers 16/1 and 16/2 higher so that the supporting bands 15 are lifted in the region of the carriage 31. The support elements 21 pressing aginst the carriage 31 and moved together with the carriage 31 are thereby relieved of the deposit force of the paper stack 14, so that friction and wear are drastically reduced.

As an alternative for the application of the support elements 21 against the individual end stops 40 by means of traction or compression springs 41, it is also possible to hold the support element 21 against the carriage 31. by means of permanent magnets until they are pulled from the carriage 31 at the end stops which, for example, can be fashioned in a resilient manner but can also be fashioned in a clamping manner.

Figure 10:
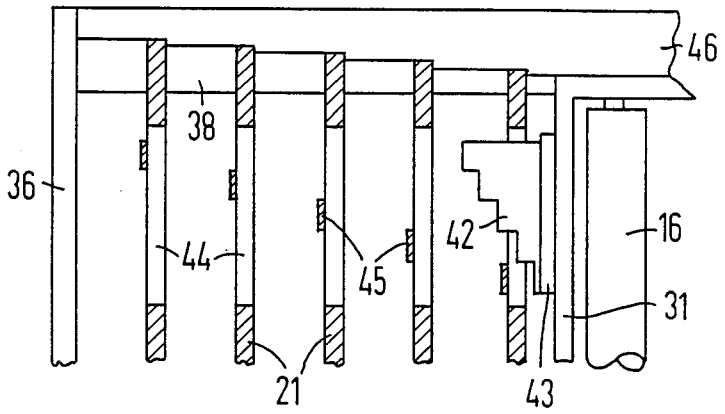
FIG. 10 is a schematic illustration of a deposit table comprising individual supporting elements which lie against detents via magnetic force.

FIG. 10 shows a corresponding exemplary embodiment. A stepped detent block 42 of low-retentivity material with an underlying permanent magnet 43 is secured to the carriage 31. Recesses 44 for the stepped detent block 42 are situated in the support elements 21. Soft iron laminae 45 are secured to the support elements 21 as seating surface, these laminae being allocated to the various steps of the magnetic detent block 42. As a consequence of the magnetic retaining force, every individual support element 21 will thereby follow the carriage 31 until it arrives at the respective end stop.

It is also possible to form the individual end stops 40 of the support elements 21 by bands or cables instead of fashioning them as a stepped end stop strip 46 as shown in FIGS. 9 and 10.

Figure 11:
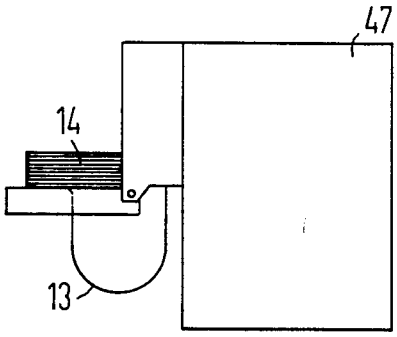
FIG. 11 is a schematic illustration of a paper stacking device integrated into a printing means, shown in its pivoted in condition.
Figure 12:
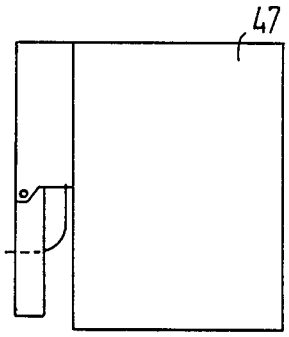
FIG. 12 is a schematic illustration of the paper stacking device of FIG. 11 shown in a pivoted out condition.

In accord with the illustrated exemplary embodiments, a corresponding stacker device can be constructed with low structural height and relatively small dimensions. In accord with the illustrations of FIGS. 11 and 12, this enables the stacking unit to be pivotably attached in a printer, for example, a laser printer. This can be utilized to automate or to at least noticeably simplify the introduction of the continuous form paper 13 between the rollers 16 of the stacking device. The printer dimensions for the transport can also be thus reduced. For this purpose, the stacker device of FIGS. 11 and 12 is pivotably arranged at the housing, whereby the illustration of FIG. 11 shows the stacker device in its work position and FIG. 12 shows it in the position pivoted in.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. A paper stacking device for pre-folded continuous form paper comprising a paper web, including a deposit table having an opening therein for receiving a supply of said paper web therethrough from below said table, wherein a paper stack is built up proceeding from below, including support surfaces for two supporting bands accepting the paper stack, the supporting bands being secured to the deposit table at one side, deflection rollers conducting said supporting bands with neighboring deflection rollers of the two supporting bands forming a feed region for stacking the paper, and a drive motor mechanism for moving the neighboring deflection rollers back and forth under the arising paper stack, comprising the improvement of an electronic control means for operatively energizing said drive motor, said drive motor being reversible in rotational sense in order to produce the reciprocating stack movement.

2. A paper stacking device according to claim 1, wherein a plurality of individual supporting elements arranged parallel to the deflection rollers are provided as the supporting surfaces.

3. A paper stacking device according to claim 1, wherein the supporting bands are secured to the deflection rollers of the feed region and are wound onto or off of said deflection rollers during the stacking motion.

4. A paper stacking device according to claim 1, wherein for the purpose of producing a stacking motion, the neighboring deflection rollers are driven via the drive motor of the feed region.

5. A paper stacking device according to claim 4, wherein the drive motor is directly allocated to the feed region and is moved together with the latter.

6. A paper stacking device according to claim 4, wherein the drive motor is stationarily arranged and is in engagement with the neighboring deflection rollers via an endless traction means.

7. A paper stacking device according to claim 6, wherein the endless traction means is fashioned as a toothed belt which is guided between the deflection rollers via a deflecting wheel.

8. A paper stacking device according to claim 1, wherein the support elements are movably conducted in guides of the supporting table and are thus mechanically coupled to one another; and in that their spacing relative to one another changes dependent on the motion of the feed region.

9. A paper stacking device according to claim 8, wherein the support elements press individually via spring elements against fixed detents of the guide which are arranged spaced and, during the stacking motion, are lifted from the detents over the feed region and are pushed together, whereby the support elements return into their original position at the detents after the change in direction of the stacking motion.

10. A paper stacking device according to claim 8, wherein the support elements individually press against fixed magnetic detents of the guide arranged spaced and, during the stacking motion, are lifted via a magnetic, stepped detent block secured to the feed region, whereby the support elements return into their original position against the detents after change in direction of the stacking motion.

11. A paper stacking device according to claim 2, including endlesss traction means which are coupled to the drive motor, wherein the support elements and the feed region are arranged on said endless traction means, and including stationary takeup rollers provided for the acceptance of the supporting bands under the feed region, these takeup rollers being in engagement with the endless traction means and being driven by the latter.

12. A paper stacking device according to claim 1, wherein the paper stacking device forms a part integrated into a printer means.

13. A paper stacking device according to claim 12, wherein said paper stacking device is designed pivotable into and out of the printer housing.

14. A paper stacking device according to claim 1, wherein the deflection rollers have their radius slightly projecting beyond the seating surface of the support elements.

* * * * *